US008726937B2

(12) United States Patent
Wülfing

(10) Patent No.: US 8,726,937 B2
(45) Date of Patent: May 20, 2014

(54) CONTROL DEVICE FOR AN EXTRACTING UNIT IN THE WORK FACE OF A MINE

(75) Inventor: Gerhard Wülfing, Velbert (DE)

(73) Assignee: Tiefenbach Control Systems GmbH, Bochum (DE)

( * ) Notice: Subject to any disclaimer, the term of this patent is extended or adjusted under 35 U.S.C. 154(b) by 0 days.

(21) Appl. No.: 13/586,604

(22) Filed: Aug. 15, 2012

(65) Prior Publication Data

US 2013/0048093 A1 Feb. 28, 2013

Related U.S. Application Data

(63) Continuation of application No. PCT/DE2011/001063, filed on May 11, 2011.

(30) Foreign Application Priority Data

May 13, 2010 (DE) ..... 10 2010 020 361

(51) Int. Cl.
*F15B 13/043* (2006.01)

(52) U.S. Cl.
USPC ..... 137/625.64; 137/557; 137/884; 251/26

(58) Field of Classification Search
USPC ..... 137/625.64, 884, 551–559; 251/26
See application file for complete search history.

(56) References Cited

U.S. PATENT DOCUMENTS 4,903,529 A * 2/1990 Hodge ..... 73/168
5,845,679 A * 12/1998 Hayashi et al. ..... 137/625.64

* cited by examiner

*Primary Examiner* — John Rivell
*Assistant Examiner* — Angelisa Hicks
(74) *Attorney, Agent, or Firm* — Alston & Bird LLP

(57) ABSTRACT

The invention relates to a control device for an extracting unit in the face of a mine, for actuating the hydraulic actuator in the sense of drawing, stepping, setting, and having a plurality of main valves for connecting the actuator of the extracting unit to a main pressure line and a main return line, and a similar plurality of pilot valves, each associated with a main valve for adjusting same and connected to the main pressure line via a pilot pressure line common to all pilot valves and connected to the main return line via a return line common to the main valves and the pilot valves. The pilot pressure line can be shut off and the return line can be blocked off from the main return line and connected to a measuring device for measuring escaping hydraulic fluid.

6 Claims, 2 Drawing Sheets

Fig.1
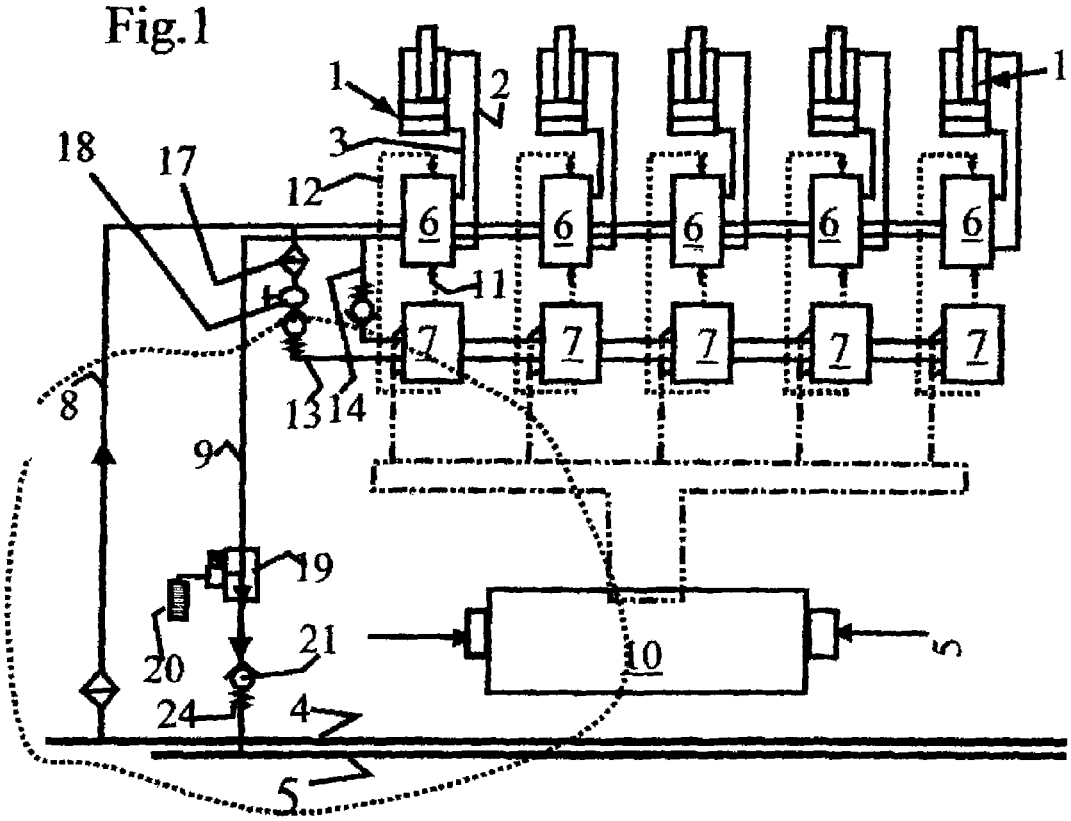
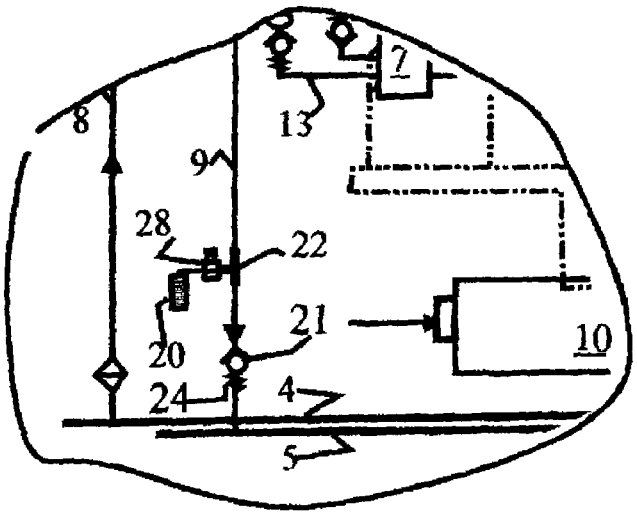
Fig.1A

CONTROL DEVICE FOR AN EXTRACTING UNIT IN THE WORK FACE OF A MINE

BACKGROUND OF THE INVENTION

1. Field of the Invention

The invention relates to a control device for an extracting unit in the face of a mine.

2. Description of Related Art

A control of this type is generally known.

However, the prior art suffers from the problem that the main valves and the pilot valves can be subject to inner leakage; in particular, in the presence of high pressures of 450 bars that occur. Due to the high energies of leakage flows, they cause damage to the main valves and/or pilot valves rendering them inoperable; in addition, a drop of hydraulically supported loads results.

Consequently, attempts are being made for detecting leaks early. However, this is a difficult feat in cases of inner leaks between main pressure and/or main return lines and return pressure and/or return lines. Attempts to detect such leaks by means of sound measurements have been unsuccessful to date, because it is not possible to distinguish permissible noises, in particular flow noises, from impermissible flow noises.

Therefore, it is the object of the present invention to be able to detect leaks at any time involving only minimal complexity in terms of devices and labor, even in existing systems while said systems are in operation.

SUMMARY OF VARIOUS EMBODIMENTS

The solution according to one embodiment is based on the realization that, although the main pressure of the face is applied to pilot and main valves from a joint main pressure line, the indicated device-related steps, as specified according to some embodiments as well as the method steps according to other embodiments allow, all the same, for differentiated leak detection on main and pilot valves.

The type of measuring instrument that is employed for measuring escaping hydraulic fluid is for the most part optional. The significant aspect of any selection provides that pressures of 300 bars and higher can be accommodated, and that, at very low pressure and flow rate, at least a qualitative measurement should be possible.

The improvement according to some embodiments allows for an automated leak measurement without the need for a further switching step, as soon as the main and pilot valves are in an operating state in which the connection to the return is shut off. To this end, the recoil spring of the check valve is adjusted in such a way that there is a correlation of the pressures, which are necessary, on the one hand for the operation of the measuring instrument and, on the other hand, on the inside of the return line for opening the check valve as well as for connecting the return line (9) to the main return line (5).

In the improvement according to one embodiment, a branch-off is provided upstream of the check valve, which is available as a standard solution, for the discharge of leaked fluid to the measuring instrument. While the check valve opens and closes the return line in relation to the main return line automatically and pressure-dependently, a closure can be provided for the discharge of leaked fluid to the measuring instrument (20) in order to accommodate the operational special aspects of the measuring instrument.

The improvement according to another embodiment has the advantage that the measuring instrument remains in operation during all operational states of the control. The output signal of the measuring instrument is continuously detected; however, it is only evaluated as a leakage measurement in such operational states when the return line is not actuated by the pilot and main valves and is, therefore, switched pressure-less, meaning it should be closed by the check valve. This allows for a continuous recording of leakage measurements. It is thus possible to detect if the leakage unexpectedly increases thus pointing to the presence of a defect, or if the leakage exceeds a preset limit value requiring service and repair work on the system.

Automation is achieved in that the check valve closes the connection of the main return line to the bypass, and which check valve is shut off in the direction of flow from the bypass to the main return line (5) by a recoil spring that is considerably weaker than the recoil spring of the check valve in the return line. It is thus achieved that the bypass in relation to the main return line is open even at low pressures in the presence of which the return line to the main return line and the tank is still shut off.

Due to the fact that the flow volume meter is disposed in a bypass of the return line (9) with connection to the main return line (5), it must be able to withstand very large flow volumes, and/or it must be effectively protected against great and, in particular, flow volume pulses while, on the other hand, it is automatically actuated with sufficient precision, when the system is at a standstill. This protection is provided by the improvement as set forth in another embodiment.

Many model types of flow volume meters are commercially available and with a variety of principles of action. Some embodiments reflect the essential principles of action. Static, meaning volumetric flow volume meters, are also expedient for detecting the smallest leaks. Hydrodynamic flow volume meters with pressure measuring instrument require a flow rate; however, on the other hand, they are robust and not vulnerable even when exposed to pressure pulses.

BRIEF DESCRIPTION OF THE SEVERAL VIEWS OF THE DRAWINGS

The drawing explains the invention using embodiments. FIG. 1, FIG. 1A and FIG. 2 show control means of an extracting unit in the work face of a mine for actuating the hydraulic force-transmission device 1 (shown as a cylinder/piston unit) in the sense of a drawing, stepping and setting of the extracting unit, also referred to as the powered support assembly. The following description applies for all embodiments, unless specific reference is made to a single embodiment.

DETAILED DESCRIPTION

Figure 2:
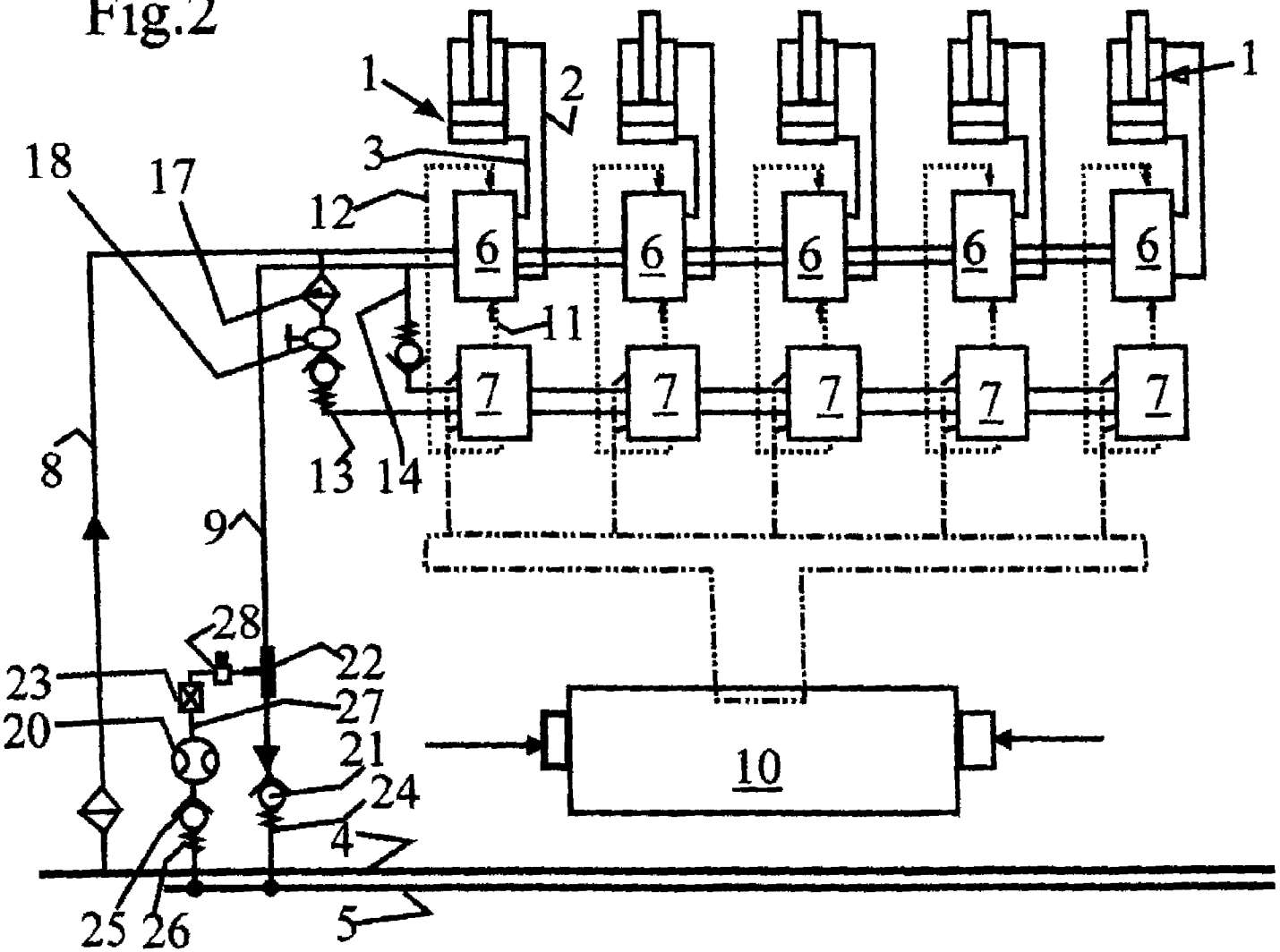

Each power-transmission device can be connected by means of lines 2 and 3 with the main pressure line 4 and the main return line 5. The main pressure line and the main return line extend through the entire the work face, meaning all extracting units are connected thereto in the shown manner. Each power-transmission device has an associated main valve 6 that controls the connection of the lines 2 and 3 to the main pressure line and the main return line. To this end, all main valves 6 are connected via pressure line 8 to the main pressure line 4 and via return line 9 to the main return line 5.

For their actuation, the main valves 6 are hydraulically pilot-controlled by pilot valves 7. To this end, the pilot valves are actuated by magnets, not shown here, of the electronic input means 10 in such a way that the main valves are actuated by means of the hydraulic control lines 11,12 in the one or the other sense. For this purpose, the pilot valves are also connected to the main pressure line 4 and the main return line 5;

specifically, to the main pressure line 4 via the line path from pressure line 8 and pilot pressure line 13, and to the main return line 5 via the line path from return line 9 and pilot return line 14. Using the pilot valves, the necessary pressure for adjusting and holding the pressure in the main valves is adjusted in lines 11 and 12.

Furthermore, the hydraulic system is provided with check valves and filters that do not require any further description in the present context.

A filter 17 is mounted in the pilot pressure line 13 that is common to all pilot valves. Said filter can be exchanged with a barrier that is presently additionally depicted as shut-off valve 18.

Regarding FIG. 1:

A branch-off valve is installed in the return line 9 that is common to all valves, meaning main and pilot valves, that shuts off the connection to the main return line 5 and by means of which the return line can be connected to a measuring instrument 20.

However, the return line can also be shut off solely by means of the check valve 21 alone, which must always be present to prevent that any pressure that may become built up in the main return line from reaching the return line 9. Said check valves 21 is preloaded by a recoil spring 24, for example, having a spring force corresponding to 2 bars. The branch-off valve 19 is replaced by a T-piece 22 in the return line 9, having the branch-off for the discharge of leakage to the measuring instrument 20 serving for measuring the leak.

This can be seen in the detail view as depicted in FIG. 1A. Since this leakage discharge is pressure-less, the closing force of the recoil spring 24 in check valve 21 is sufficient for closing the connection between the return line 9 and the main return line 5. Thus, the leak cannot flow back into the main return line 5; instead, it cannot help but reach the measuring instrument 20. A shut-off valve 28 can be provided in the branch-off for deactivating the leak-measuring action.

The measuring instrument can be, for example, a measuring vessel that collects the volume of the leaked hydraulic fluid occurring over a given time unit, and by which it can be measured.

Preferably, all of the valves and lines shown herein, including filters, check valves, etc. of a powered supply assembly or of a group of force-transmission devices of the powered support assembly are housed and arranged inside a steel block. This has, until now, impeded the detection of leaks on the inside of such a steel block because said steel block is connected to the main pressure line pressure, (e.g.) 450 bars, as well as the main pressure return line pressure, (e.g.) 30 bars, which is why leaks do not escape to the outside.

However, by means of the additional equipment according to the invention, it is possible to detect if inner leaks of impermissible size are present and, if so, in what amount said leaks must be associated with leakage at the location of the pilot or main valves.

To this end, first, by actuating the shut-off valve 18 or exchange of the filter 17, the pilot pressure line 13 is shut off by means of a (not shown) shut-off element. The branch-off valve 19 is then readjusted in order to shut off the connection of the return line 9 to the main return line 5, establishing instead the connection to the measuring instrument 20. The leakage during a given time unit provides the first measured value. The pilot pressure line is now reopened and the leak is measured once more for the given time unit as a second measured value. The first measured value represents any leakage solely of the main valves; the second measured value represents the inner leak for the entire system. The difference between the first and second measured values represents the leakage for the pilot values. If one of these values and/or the difference exceeds a preset limit, the system is deactivated until the leak has been repaired by a replacement of the affected valve elements.

Regarding FIG. 2:

A T-shaped branch-off 19 is mounted in the return line 9 that is common to all valves, meaning main and pilot valves, to which a bypass 27 with connection to the main return line 5 is connected. Bypass 27 circumvents the check valve 21. A flow volume meter is disposed in the bypass as a measuring instrument 20, as well as a second check valve 25. Said check valve 25 has the same flow direction as the check valve 21 and prevents pressure that can build up in the main return line from reaching the bypass 27. Said check valve 25, however, is considerably weaker by means of the recoil spring 26, which is, for example, the preload is less than 1 bar, than the check valve 21, on the other hand, which has a recoil spring 24 having, for example, a preload of 2 bars. A damper is disposed upstream of the flow volume meter as a flow resistance 23. This way, it is possible to limit the flow volume of the bypass as well as the pressure upstream of the flow volume meter to such a measure as is allowable for the flow volume meter and tolerable as volume loss for the pilot control. Instead of or in addition to the damper, bypass 27 can be equipped with a shut-off valve 28 that is only opened for leakage measurements, see FIG. 1A.

Moreover, using the equipment according to FIG. 2, once again, not only is it possible to detect if inner leaks are present and, if so, whether of impermissible volume or not, but also if and at what level these leaks must be associated to pilot or main valves. It is to be noted that the control device 10 detects the output signal of the flow volume meter 20 as a continuous electronic signal via a line that is presently not shown. However, the control device also detects the operating state of the pilot and main control valves. The control device is thus able to detect as to whether an operating state of the pilot and main control valves is actuated for which the return flow line should not have a return flow to the tank. The control device is able to evaluate the output signal of the flow volume meter 20 that is incoming with these operating states as a signal indicating a leak. By actuating the shut-off valve 18 (or replacement of the filter 17 by a (presently not shown) shut-off element), the pilot pressure line 13 can be shut off. Pressure is thus not applied to the pilot valves, and the same are in their resting position. The return line 9 by itself is able to accommodate leakage flow of the main control valves. Said leakage flow generates only minimal pressure that is insufficient for opening the check valve 21 against the spring force 24; however, it is sufficient for opening the check valve 25 in the bypass 27 against the spring force 26. The connection of the return line 9 to the main return line 5 is thus created by means of the measuring instrument/flow volume meter 20. The leakage of the main control valves can thereby be detected over a given time unit. The shut-off valve 18 of the pilot pressure line can also be opened. The leakage volume that is collected during the same time unit originates from the total system of the pilot and main control valves. The difference of the first and second measured values represents the leakage only for the pilot valves. If one of these measured values and/or the difference exceeds a preset limit, the control device 10 brings the total system to a standstill so that the leak can be repaired, for example by replacement of the affected valve elements.

The invention claimed is:

1. A control device for an extracting unit in the face of a mine for actuating a hydraulic force-transmission device in the sense of drawing, stepping and setting, comprising:

a plurality of main valves for connecting the force-transmission device of the extracting unit to a main pressure line and a main return line having pilot valves, which are each associated with a main valve for adjusting the same; and a pilot pressure line that is common to all pilot valves and connected to the main pressure line and that is connected to the main pressure line via a return line that is common to the main valves and the pilot valves, wherein the pilot pressure line can be shut off, and wherein the return line can be shut off toward the main return line, and wherein the return line can be connected to a measuring instrument for measuring any escaping hydraulic fluid.

2. The device according to claim 1, wherein the return line can be shut off toward the main return line in that the connection of the main return line to the return line is closed off by a check valve, which is closed off in the direction of flow from the return line to the main return line by means of the spring force of the recoil spring of the check valve against the pressure of the return line, and wherein the spring force of the recoil spring is adjusted such that the check valve does not release the connection of the return line to the main return line until the pressure in the return line exceeds a set limit pressure, and wherein the limit pressure is set as higher than the pressure for operating the measuring instrument.

3. The device according to claim 2, wherein a branch-off is disposed upstream of the check valve for the discharge of leaked fluid to the measuring instrument that is continuously open for the flow between the return line toward the main return line and that can be, preferably, closed off for the discharge of leaked fluid to the measuring instrument.

4. The device according to claim 1, wherein the measuring instrument is a flow volume meter, in that the flow volume meter is disposed in a bypass of the return line with connection to the main return line, wherein the connection of the main return line to the bypass is closed off by a check valve that is closed in the flow direction by the bypass toward the main return line by means of the spring force of the recoil spring of the check valve against the pressure in the bypass, and wherein the spring force of the recoil spring is adjusted such that the check valve releases the connection from the bypass to the main return line, when the pressure in the bypass is smaller or equal to the pressure for the operation of the measuring instrument, in particular the necessary starting pressure thereof.

5. The device according to claim 4, wherein a flow resistance, damper or orifice plate is disposed in the bypass.

6. A method for the operation of a control device for an extracting unit in the face of a mine, comprising:

shutting off a pilot pressure line, and measuring a leak by a first measured value; and opening the pilot pressure line and measuring the leak by a second measured value, wherein the first measured value indicates a leak of main valves, and a difference of the first and second measured value indicates a leak of pilot valves.

* * * * *